United States Patent [19]

Murayama et al.

[11] 4,371,319

[45] Feb. 1, 1983

[54] HERMETIC MOTOR COMPRESSOR

[75] Inventors: Akira Murayama; Fumio Harada; Tetsuya Arata; Masato Itagaki, all of Shimizu; Susumu Nakayama, Shizuoka; Masahisa Sofue, Minorimachi, all of Japan

[73] Assignee: Hitachi, Ltd., Tokyo, Japan

[21] Appl. No.: 167,031

[22] Filed: Jul. 9, 1980

[30] Foreign Application Priority Data

Jul. 13, 1979 [JP] Japan ..... 54/88123

[51] Int. Cl.[3] ..... F04B 21/00

[52] U.S. Cl. ..... 417/312; 417/313; 417/371; 417/902

[58] Field of Search ..... 417/313, 312, 363, 902, 417/371; 62/505, 296

[56] References Cited

U.S. PATENT DOCUMENTS

| | | | |
|---|---|---|---|
| 3,049,285 | 8/1962 | Doeg | 417/902 X |
| 3,101,891 | 8/1963 | Frank | 417/371 X |
| 3,187,992 | 6/1965 | Roelsgaard | 417/902 X |
| 3,664,769 | 5/1972 | Knudsen et al. | 417/902 X |
| 3,926,009 | 12/1975 | Parker et al. | 62/296 |

FOREIGN PATENT DOCUMENTS

| | | | |
|---|---|---|---|
| 46-18061 | 5/1971 | Japan . | |
| 53-13213 | 2/1978 | Japan | 417/313 |

*Primary Examiner*—Carlton R. Croyle
*Assistant Examiner*—Edward Look
*Attorney, Agent, or Firm*—Antonelli, Terry & Wands

[57] ABSTRACT

A hermetic motor compressor for compressing refrigerant gas in air conditioners or refrigerators. The hermetic motor compressor includes a motor compressor disposed in a closed housing and consisting of a motor section and a compressor section formed integrally with each other. The compressor section has a cylinder head cover, discharge silencer and discharge tube through which the compressed refrigerant gas is discharged to the outside. The cylinder head cover, discharge silencer and discharge tube are covered by heat insulating members with suitable spaces provided therearound. Heat radiation from the discharge system is therefore prevented by the spaces as well as by the heat insulating members, so that the temperature rise of refrigerant gas in the closed housing is avoided to ensure a higher volumetric efficiency of the compressor.

14 Claims, 11 Drawing Figures

HERMETIC MOTOR COMPRESSOR

BACKGROUND OF THE INVENTION

The present invention relates to a hermetic motor compressor for compressing refrigerant in air conditioners, refrigerators or the like. In air conditioners or refrigerators, a closed circuit of refrigerant is formed by successively connecting a refrigerant compressor, condenser, pressure reducer and an evaporator.

Compressed refrigerant gas discharged from the refrigerator compressor is cooled and liquefied in the condenser and flows through the pressure reducer into the evaporator where it absorbs heat from a fluid to be cooled so as to be evaporated. The refrigerant then flows back to the compressor to complete one cycle of operation. The fluid to be cooled is cooled as a result of heat absorption in the evaporator and is used as a cold heat source for air conditioners or refrigerators.

Hermetic motor compressors are broadly used as a refrigerant compressor. This hermetic motor compressor has a closed container or housing which houses an electric motor and a compressor integrally connected to each other. Since the closed housing thermally insulates its interior from the outside, the temperature of the compressor is raised to a high level to undesirably heat surrounding refrigerant gas in the closed housing. In consequence, the refrigerant gas of low temperature, which has returned from the evaporator of the refrigerant circuit to temporarily stay in the closed housing is heated by the heat generated by the compressor, so that the cylinder of the compressor is made to suck the refrigerant of a high temperature and, hence, a large specific volume. Consequently, the weight rate of the refrigerant gas flow sucked by the cylinder of the compressor is reduced to lower the volumetric efficiency of the compressor, which in turn results in lowering the refrigeration power per unit input power. The refrigerant gas which is delivered into the closed housing through a refrigerant return pipe is heated by the heat radiated from the discharge pipe of high temperature, discharge silencer, head cover and other parts of high temperature to be increased in its specific volume, so that the weight of the refrigerant gas displaced by a particular cylinder is decreased to deteriorate the performance of the compressor and to pose various other problems.

In order to obviate the above-described shortcomings of the prior art, it has been proposed to limit the heat radiated from the discharge pipe.

For instance, U.S. Pat. No. 3,926,009 discloses a hermetic compressor in which, a double-walled discharge tube that is insulated so as to prevent undesirable heat transfer between the discharge tube and the cool refrigerant as well as heat transfer between the discharge tube and the lubricant and in which, said discharge tube has one or both of inner and outer tublar members corrugated to prevent transmission of vibration from the compressor to the closed housing. In this hermetic compressor, heat insulating means is provided only for the discharge tube, and no specific consideration is given to the thermal insulation of the silencer and head cover.

Japanese Patent Publication No. 18061/1971 discloses a hermetic compressor having means for thermally insulating the discharge tube and discharge silencer thereby to lower temperature in the closed housing. More specifically, this thermal insulating means includes a heat insulating layer or foil provided around the discharge tube and discharge silencer to reduce heat radiation from the tube to the interior of the closed housing. The discharge tube is in the form of hose to absorb vibration of the compressor. The heat insulation layer is closely adhered to the outer surface of the discharge tube and discharge silencer.

SUMMARY OF THE INVENTION

It is an object of the invention to prevent heat radiation from a head cover, discharge silencer, discharge tube and other parts in a discharge circuit of the compressor thereby to prevent the surrounding refrigerant gas from being heated to obtain a higher volumetric efficiency of the compressor.

It is another object of the invention to provide heat insulating means having a construction suitable for obviate heat radiation from the discharge circuit of the compressor.

To these ends, according to the invention, there is provided a hermetic motor compressor comprising a motor compressor consisting of a compressor and a motor integrally connected with each other, a closed housing receiving therein said motor compressor, and heat insulating means which covers a head cover, discharge silencer and discharge tube connected to the latter with a suitable space or gap provided therearound.

In operation, refrigerant gas in the refrigeration system flows from the evaporator back into the closed housing through a refrigerant return tube and is sucked in a cylinder of the compressor via the suction passage to be compressed by the reciprocating piston. The resulting compressed gas of high pressure and temperature is discharged into a discharge chamber formed in the head cover and hence to the outside of the hermetic motor compressor via the discharge silencer and discharge tube. The compressed refrigerant gas then flows into the condenser.

According to the invention, the head cover, discharge silencer and the discharge tube are covered by the heat insulating member with a suitable space or gap provided therearound, so that heat radiation is insulated by the air gap and the heat insulating member to effectively prevent heat transfer, thereby to improve the volumetric efficiency of the compressor without overheating the refrigerant gas in the closed housing.

According to one aspect of the invention, a multiplicity of projections of suitable lengths are formed on the inner surface of the cover, so that the head cover and silencer are clamped by these projections with a suitable space or gap provided therearound. An annular projection is formed at the portion of the heat insulating member penetrated by the pipe. The discharge pipe is covered by a sleeve and a bellows-type sleeve and is inserted at its one end into the bore defined by the annular projection to leave a suitable space or gap therearound. This arrangement further increases the heat insulating effect because of the gas layer formed around the head cover, discharge silencer and the discharge pipe. In addition, since the heat insulating member is fitted to the head cover and the silencer, while the discharge pipe is covered by a heat insulating bellows-type sleeve, it is possible to attach the heat insulating member with a space or gap formed around the head cover and the silencer, so that the attaching work is considerably facilitated.

BRIEF DESCRIPTION OF THE DRAWINGS

The invention will be more fully understood from the following description of the preferred embodiments taken in conjunction with the accompanying drawings in which.

DESCRIPTION OF THE PREFERRED EMBODIMENTS

Figure 1:
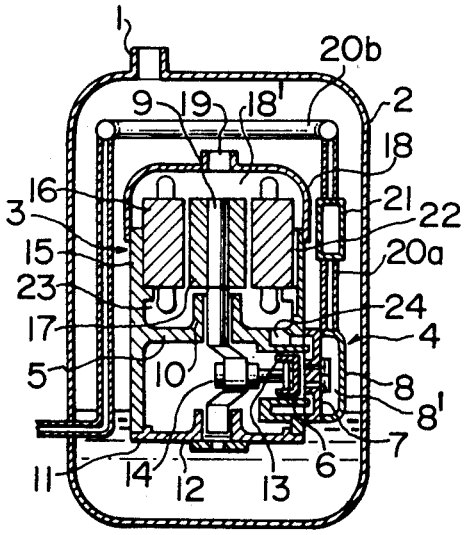
FIG. 1 is a vertical sectional view of a hermetic motor compressor according to an embodiment of the invention.
Figure 2:
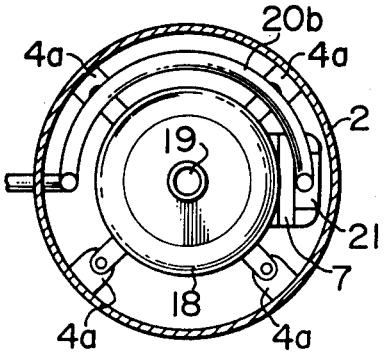
FIG. 2 is a top plan view of the hermetic motor compressor shown in FIG. 1 with a part of the closed housing being removed.

In FIGS. 1 and 2 there is shown a hermetic motor compressor constructed in accordance with a first embodiment of the invention; a motor compressor consisting of an electric motor 3 and a compressor 4 formed below the motor 3 is mounted through four resilient supporting devices 4*a* in a closed housing 2 provided with a refrigerant return tube 1. The compressor has a partition wall 5 and a cylinder 6 integrally formed therewith. A cylinder head 7 and a head cover 8 are attached to one side of the cylinder 6. A crank shaft 9 is integrally formed with the motor shaft and is journaled by an upper bearing 10 provided on the center of the partition wall 5 and a lower bearing 12 formed in the lower cover 11. The crank shaft 9 is connected through a connecting rod 14 to a piston 13 received by the cylinder 6. The motor includes a stator 16 fixed to a frame 15 formed at its periphery with a partition wall 5. A rotor 17 fixed to the motor shaft is disposed in facing relationship with the stator 16. A reference numeral 18 disignates a motor cover which covers the upper portion of the motor, and is provided at its top with a suction port 19. Reference numerals 20*a*, 20*b* denote discharge tubes connected to the head cover 8. These pipes are connected to each other through a silencer 21. The discharge tube 20*b* is disposed in an arc of a circle along the inner periphery of the closed housing to extend to the lower portion of the closed housing. The lower end of this tube penetrates the closed housing 2 and is fixed thereto.

The refrigerant gas of low temperature flowing through the refrigerant return tube 1 into the closed housing 2 is delivered in the latter and is then introduced into a cover chamber 18' of the motor through a suction port 19. The gas then flows through an outer peripheral passage 22 about the stator 16, as well as through the air gap between the stator 16 and the rotor 17, into a lower chamber 23 of the motor. It will be seen that the motor is effectively cooled by this flow of refrigerant. The refrigerant gas is then sucked into the cylinder 6 through a suction port 24 and a valve mechanism mounted on the cylinder head 7. The refrigerant gas is compressed by the reciprocating movement of the piston 13 to be discharged into the discharge chamber 8' of the head cover 8, and is delivered to the outside through the discharge tube 20*a*, silencer 21 and the discharge tube 20*b*.

Figure 3:
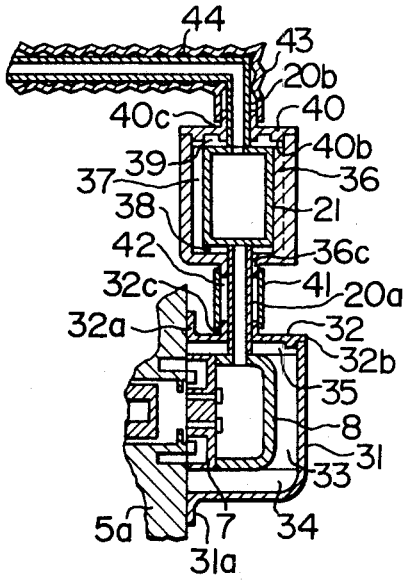
FIG. 3 is a detailed enlarged view of heat insulating means provided around the head cover of a compressor, discharge silencer and discharge tube.

Although not shown, the cylinder head 7, head cover 8, silencer 21 and discharge tubes 20*a*, 20*b* are covered by teflon or other heat insulating plastics. FIG. 3 shows the discharge system covered by this heat insulating member. It will be seen that a cover 31 and a lid 32 formed of teflon or other heat insulating plastics are provided around the cylinder head 7 and head cover 8 with spaces or gaps 33, 34, 35 provided therebetween. As will be seen from FIGS. 4 and 5, the cover 31 is provided at its periphery with a peripheral flange 31*a*, and is provided at its inner surface with a plurality of projections 31*b*. As shown in FIG. 3, the cover 31 is adhered at its peripheral ridge 31*a* to the frame 5*a* of the partition wall 5 as by an addhesive. Alternatively, the cover 31 is fixed by screws. Thus the cover 31 is fixed such that the projections 31*b* engage the head cover 8 to define suitable spaces or gaps 33, 34 therebetween. The lid 32 is formed of the same material as the cover 31, and is provided with a peripheral ridge 32*a* and projection 32*b* adapted to fit into the cover 31, said peripheral ridge 32*a* being fixed by an adhesive or screws to the frame 5*a*. In the fixed state, the projection 32*b* fits in the cover 31 to form a space 35. Also, an annular projection 32*c* is provided at the portion of the lid 32 penetrated by the discharge tube 20*a*.

Figure 6:
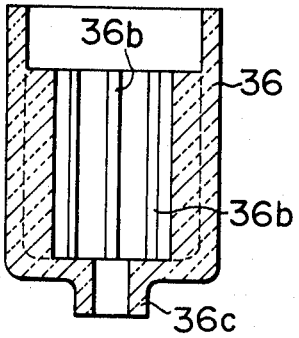
FIG. 6 is a sectional view of a heat insulating cover for covering the discharge silencer.
Figure 7:
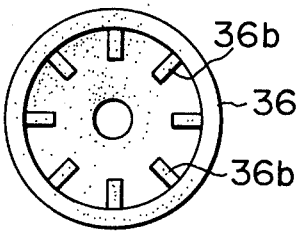
FIG. 7 is a top plan view of the heat insulating cover shown in FIG. 7.

The silencer 21 is also covered by a cover 36 and a lid 40 which are formed of teflon or other heat insulating resin with spaces 37, 38, 39 formed therearound. As will be seen from FIGS. 6 and 7, this cover 36 is in the form of a bottomed cylinderical body which is provided on its inner surface with a plurality of projections 36*b*. These projections 36*b* serve to retain the silencer 21 therein to form spaces 37, 38 around the silencer 21. Also, an cylindrical projection 36*c* is formed on the cover 36 for passing the discharge tube 20*a* therethrough.

Figure 8:
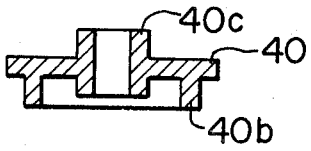
FIG. 8 is a sectional view of a lid adapted to be fitted to the top of the heat insulating cover shown in FIG. 6.
Figure 9:
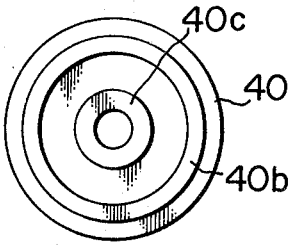
FIG. 9 is a bottom plan view of the lid shown in FIG. 8.

The lid 40 is formed of the same material as the cover 36, and includes a projection 40*b* adapted to be fitted in the cover 36 and a cylindrical projection 40*c* for passing the discharge tube 20*a* therethrough, as will be seen from FIGS. 8 and 9. The lid 40 is fixed with its projection 40*b* fitted in the cover 36 to leave a space 39.

The discharge tubes 20*a*, 20*b* are also covered by sleeve or tubular members made of teflon or other heat insulating plastics having flexibility. More specifically, a tubular member 41 is fixed at its one end to the annular projection 32*c* of the lid 32 and at its other end to the cylindrical projection 36*c* of the cover 36 to surround the discharge tube 20*a* with a suitable space 42 formed around the latter.

A bellows-like tubular member 43 is provided around the discharge tube 20*b* with its one end inserted in the cylindrical projection 40*c*. A suitable space 44 is formed between the discharge tube 20*b* and the tubular member 43. Although omitted from the drawing, this tubular member 43 is provided over the entire length of the discharge tube 20*b*.

As described above, the head cover 8, discharge tube 20*a*, silencer 21 and the discharge tube 20*b* are covered by the heat insulating members with suitable spaces provided therebetween, so that heat radiation from the discharge system is interrupted by the space around the discharge system and by the heat insulating members, thereby ensuring that heat radiation to the surrounding refrigerant gas in the closed housing can be avoided almost completely.

The mounting of the heat insulating members can be readily performed because these members are constructed in a manner as to be fitted to the head cover, discharge silencer and the discharge pipe by projections.

Figure 10:
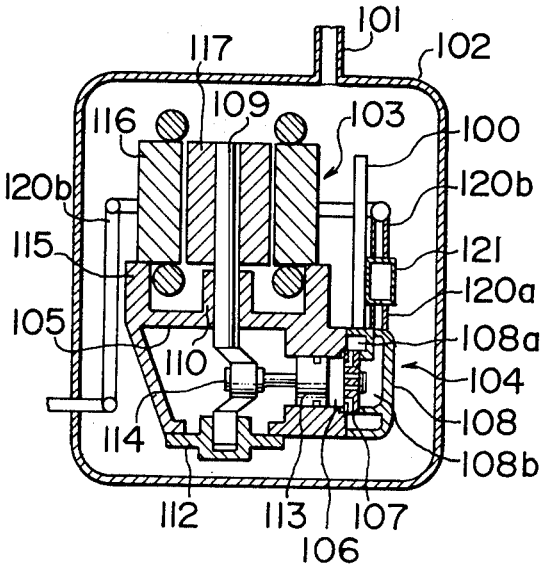
FIG. 10 is a vertical sectional view of a hermetic motor compressor according to another embodiment of the invention.
Figure 11:
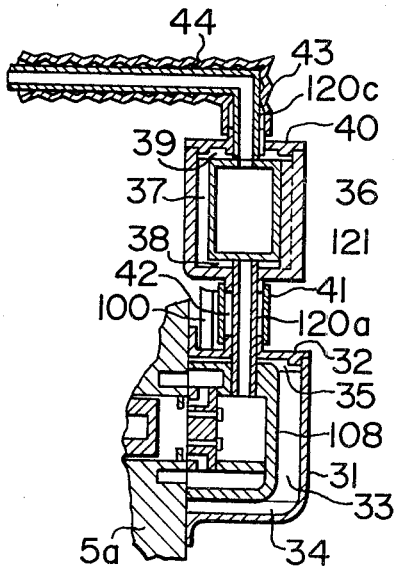
FIG. 11 is a detailed enlarged view of heat insulating means of the compressor shown in FIG. 11.

FIG. 10 shows another embodiment of the present invention. While according to the preceding embodiment a motor cover is provided with a suction port to cover the motor to permit the suction gas to flow through a passage in the motor into the compressor, according to the embodiment of FIG. 10 a suction tube 100 is separately formed on a head cover 108 and the refrigerant gas is sucked in the compressor through this suction pipe 100. A motor compressor including a motor 103 at its upper portion and a compressor 104 at its lower portion is mounted by resilient supporting means (not shown) in a closed housing 102 provided with a refrigerant return tube 101. The compressor 104 includes, as in the case of the first embodiment, a cylinder 106 integral with a partition wall 105, crank shaft 109 integral with the motor shaft, upper bearing 110 and lower bearing 112 journaling the crank shaft 109, piston 113 and a piston rod 114. A cylinder head 107 is attached to the end of the cylinder 106 and a head cover 108 is attached to the outside of the cylinder head 107. The head cover 108 is provided with a suction chamber 108*a* and a discharge chamber 108*b*. The motor 103 has a frame 115 integral with the partition wall 105 to which is fixed by means of bolts or the like a stator 116. Internally of the stator 116 is disposed a rotor 117 fixed to the motor shaft. The aforementioned suction tube 100 extends up right from the head cover 108 and is opened to the suction chamber 108 to have a length to the upper portion of the closed housing. The upper end of the suction tube 100 is kept opened. The head cover 108 is further provided with a discharge tube 120*a* communicating with the discharge chamber 108*b*. The discharge tube 120*a* is connected to a discharge silencer 121 which in turn is connected to a discharge tube 120*b*. The discharge tube 120*b* is extended in an arc of a circular along the inner periphery of the closed housing 102 and is secured to the lower part of the housing to extend therethrough. As shown in FIG. 11, heat insulating members are disposed around the head cover 108 discharge tube 120*a*, discharge silencer 121 and the discharge tube 120*b*, as in the case of the preceding embodiment.

Figure 4:
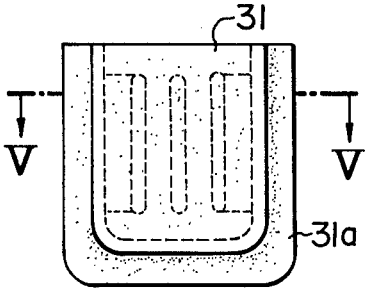
FIG. 4 is a front elevational view of a heat insulating cover for covering the head cover.
Figure 5:
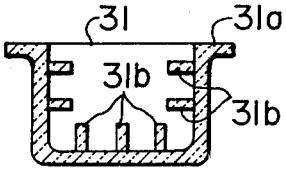
FIG. 5 is a sectional view taken along the line V—V of FIG. 4.

These heat insulating members are formed of teflon or other heat insulating plastics as in the case of the embodiment shown in FIG. 3. A cover 31 and a lid 32 similar to those of the preceding embodiment shown in FIGS. 4 and 5 are disposed around the head cover 108 with suitable spaces 33, 34, 35 provided between the same and the head cover 108. A cover 36 and a lid 40 similar to those shown in FIGS. 6 to 9 are provided to cover the discharge silencer 121 with spaces 37, 38, 39 around the latter. Further, as in the arrangement shown in FIG. 3, the discharge tube 120*a* is surrounded by a tubular member 41 with a space 42 provided therearound. Also, the discharge tube 120*b* is surrounded by a bellows-like tubular member 43 with a suitable space 44 provided therearound, as in the case of arrangement shown in FIG. 3.

Thus, the head cover 108, discharge tube 120*a*, discharge silencer 121 and the discharge tube 120*b* are covered by heat insulating members also in this embodiment. Therefore, heat radiation is interrupted by the space around the discharge system as well as by the heat insulating members, so that heat radiation from the discharged refrigerant gas is securedly prevented, as in the case of the preceding embodiment. In addition, the heat insulating members can be readily mounted since they have projections for fitting on the head cover, discharge silencer and the discharge pipe.

What is claimed is:

1. A hermetic motor compressor comprising: a closed housing provided at its upper portion with refrigerant gas return tubes through which a refrigerant gas is introduced thereinto to form an atmosphere of said refrigerant gas therein; a motor compressor having a motor at its upper area and a compressor at its lower area, said motor and compressor being connected to each other, said motor compressor being mounted in said closed housing by means of resilient support means; and heat insulating members covering an outer surface of a discharge chamber enclosing head cover, a discharge silencer and discharge tubes that are connected to said discharge silencer, spaces being provided between said heat insulating members and said head cover, discharge silencer and discharge tubes.

2. A hermetic motor compressor as claimed in claim 1 comprising a motor cover for covering the top portion of said motor and provided with a suction port formed therein, a suction bore formed in a frame defining a lower chamber of said motor and communicated with a suction valve on a cylinder head to permit the refrigerant gas to be introduced into said motor cover and thence into said lower chamber of said motor through a passage formed in said motor and then to be sucked into the cylinder of said compressor through said suction bore.

3. A hermetic motor compressor as claimed in claim 1 comprising a suction chamber in said head cover, a suction tube formed on said head cover and opened to said suction chamber, so that said refrigerant gas is sucked into the cylinder of said compressor through said suction tube.

4. A hermetic motor compressor as claimed in claim 1 wherein said heat insulating member covering the outer surface of said head cover is provided at its inner surface with a plurality of projections which contact and embrace said head cover to provide spaces therebetween.

5. A hermetic motor compressor as claimed in claim 1 wherein said heat insulating member covering the outer surface of said head cover includes a cover body provided at its inner surface with a plurality of projections of suitable lengths which contact and embrace said head cover, and a lid fitted in the top of said cover body.

6. A hermetic motor compressor as claimed in claim 1 wherein said heat insulating member covering said discharge silencer is provided at its inner surface with a plurality of projections which contact and embrace said discharge silencer to provide a suitable space therearound.

7. A hermetic motor compressor as claimed in claim 1 wherein said heat insulating member includes a bottom-equipped cover body provided at its inner surface with a plurality of projections of suitable lengths adapted to contact and embrace said discharge silencer, and a lid fitted in the opened end of said cover body.

8. A hermetic motor compressor as claimed in claim 1 wherein said heat insulating member for covering one of the discharge tubes that extends from said discharge silencer along the inner surface of said closed housing comprises a bellows-like tubular member for surrounding said discharge tube.

9. A hermetic motor compressor as claimed in claim 1 wherein said heat insulating members are made of polytetrafluoroethylene.

10. A hermetic motor compressor as claimed in claim 1, wherein at least one of the heat insulating members covering the head cover and the muffler comprises a rigid casing having a body portion surrounding the respective one of the head cover and muffler, with clearance and a plurality of projections which extend from the body portion so as to contact and embrace the respective one of the head cover and muffler.

11. A hermetic motor compressor as claimed in claim 1 or 10 wherein said heat insulating members are formed of heat insulating plastics.

12. A hermetic motor compressor as claimed in claim 1, wherein both the heat insulating members covering the head cover and the muffler comprises a rigid casing having a body portion surrounding the respective one of the head cover and muffler, with clearance and a plurality of projections which extend from the body portion so as to contact and embrace the respective one of the head cover and muffler.

13. A hermetic motor compressor as claimed in claim 1 or 12, wherein said heat insulating member covering one of the discharge tubes that interconnects said head cover and said discharge silencer comprises a tublar member having its opposite ends inserted into projections which are formed on said heat insulating members for said head cover and said discharge silencer at portions thereof for passing-through of said discharge tube.

14. A hermetic motor compressor according to claim 4 or 5 or 6 or 7 or 10 or 12, wherein said projections are axially extending ribs.

* * * * *